US008051527B2

(12) United States Patent
Lee

(10) Patent No.: US 8,051,527 B2
(45) Date of Patent: Nov. 8, 2011

(54) CLEANING ROBOT SYSTEM OF SATELLITE TYPE

(75) Inventor: Ba-Do Lee, Seongnam-si (KR)

(73) Assignee: Ba-Do Lee, Seongnam-si (KR)

( * ) Notice: Subject to any disclaimer, the term of this patent is extended or adjusted under 35 U.S.C. 154(b) by 541 days.

(21) Appl. No.: 12/296,794

(22) PCT Filed: Apr. 4, 2007

(86) PCT No.: PCT/KR2007/001638

§ 371 (c)(1),
(2), (4) Date: Oct. 10, 2008

(87) PCT Pub. No.: WO2007/117095

PCT Pub. Date: Oct. 18, 2007

(65) Prior Publication Data

US 2009/0271940 A1 Nov. 5, 2009

(30) Foreign Application Priority Data

Apr. 10, 2006 (KR) ..... 10-2006-0032204

(51) Int. Cl.
*A47L 5/00* (2006.01)

(52) U.S. Cl. ..... 15/319; 15/339; 15/340.1

(58) Field of Classification Search ..... 15/319, 15/340.1, 339, 307, 359, 414, 323, 321
See application file for complete search history.

(56) References Cited

U.S. PATENT DOCUMENTS

| | | | | |
|---|---|---|---|---|
| 5,815,881 | A * | 10/1998 | Sjogreen | 15/321 |
| 6,598,262 | B2 * | 7/2003 | Farina | 15/321 |
| 6,925,679 | B2 | 8/2005 | Wallach et al. | |
| 2004/0111822 | A1 * | 6/2004 | Syu | 15/321 |
| 2005/0055792 | A1 * | 3/2005 | Kisela et al. | 15/319 |
| 2009/0133720 | A1 * | 5/2009 | Van Den Bogert | 134/18 |

FOREIGN PATENT DOCUMENTS

| | | | |
|---|---|---|---|
| JP | 05337063 | A * | 12/1993 |
| JP | 2004-236733 | A | 8/2004 |
| KR | 10-1994-0002584 | B1 | 3/1994 |
| KR | 20-1997-0000317 | Y1 | 1/1997 |
| KR | 10-2005-0012049 | A | 1/2005 |

* cited by examiner

*Primary Examiner* — Dung Van Nguyen
(74) *Attorney, Agent, or Firm* — Sughrue Mion, PLLC

(57) ABSTRACT

The present invention relates to a cleaning robot system of a satellite type. The present invention provides a cleaning robot system of a satellite type that includes a flat autonomous cleaning head, a hose assembly, and a cleaning main body. The flat autonomous cleaning head includes a suction inlet formed in a bottom thereof, a side connector communicating with the suction inlet, travel wheels provided on both side thereof, and variable speed drive motors for driving the travel wheels. The hose assembly is connected to the cleaning head and is at least partially flexible. The cleaning main body is connected to the hose assembly and includes a vacuum pump, a dust collector, a discharge air separator, a power supply, and a controller. Since the cleaning head of the cleaning robot system according to the present invention has a simple structure, it is possible to make the cleaning head thin. Further, since the cleaning robot system has high output of power and high vacuum sucking performance, it is possible to satisfactorily clean the house. Furthermore, the cleaning robot system can perform wet cleaning by ejecting steam, hot water, and wash water, unlike a disk-shaped robot cleaner. Therefore, the cleaning robot system can satisfactorily perform all kinds of cleaning options that can be performed by a manual cleaner. In addition, the cleaning robot system can have a self-washing function to perform self-washing.

6 Claims, 4 Drawing Sheets

[Fig. 1]
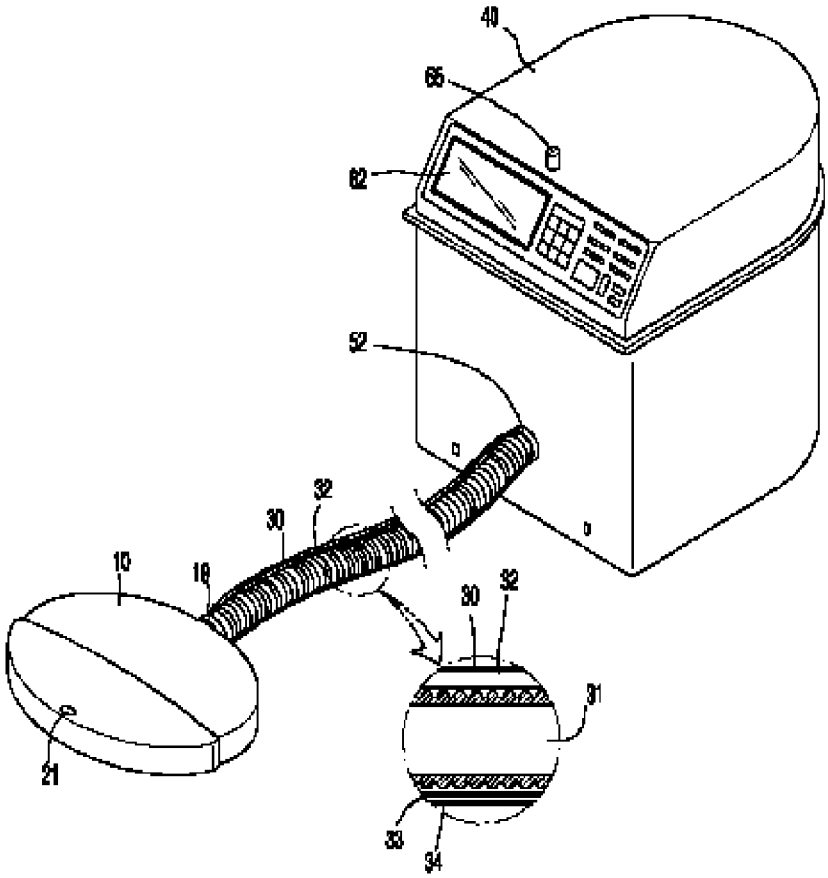
[Fig. 2]
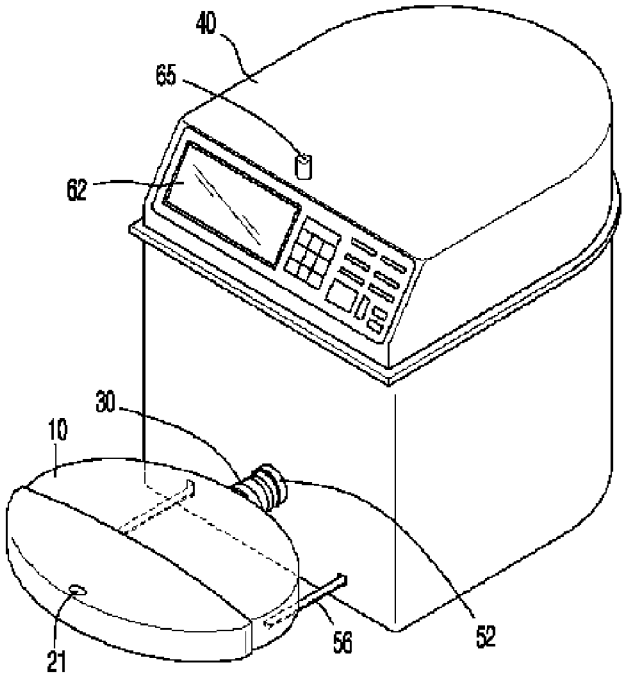

[Fig. 3]
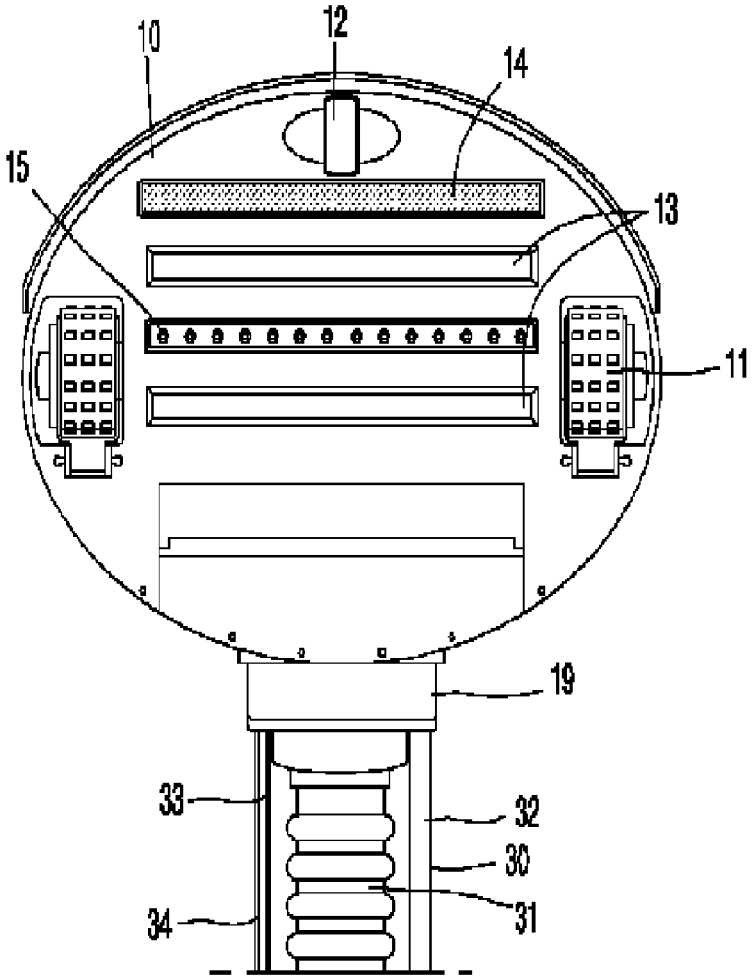
[Fig. 4]
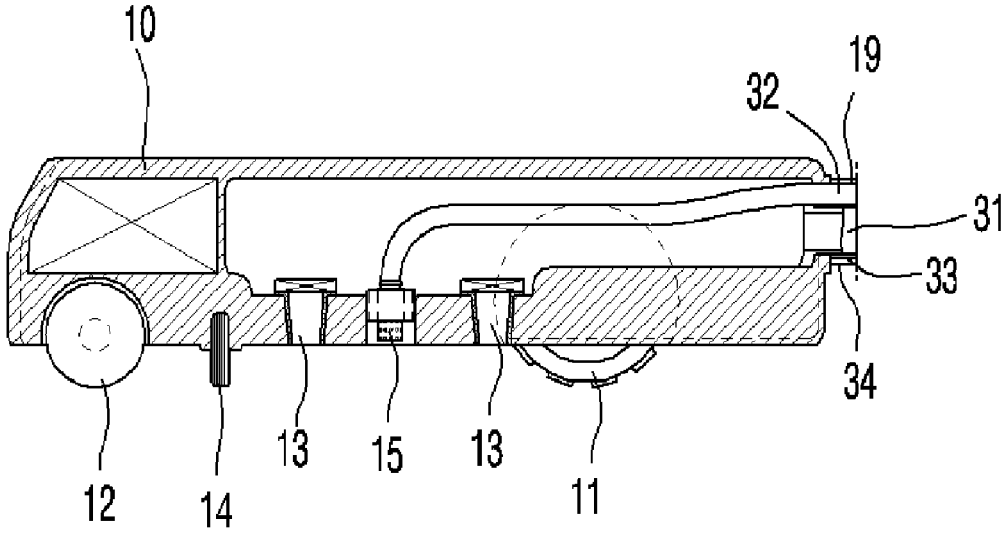

[Fig. 5]
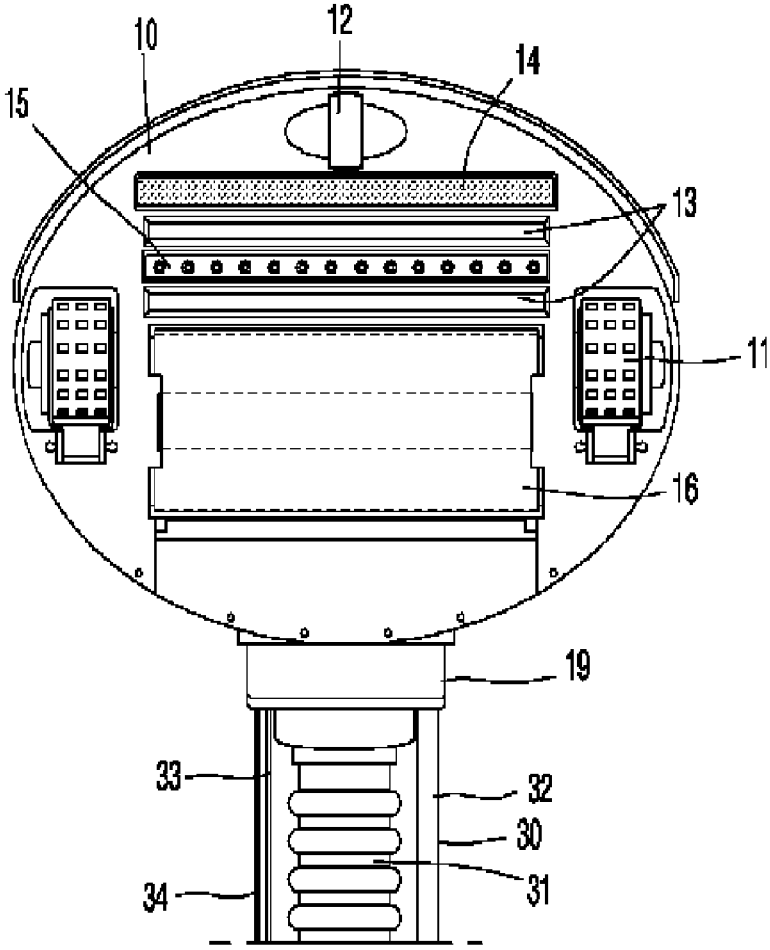
[Fig. 6]
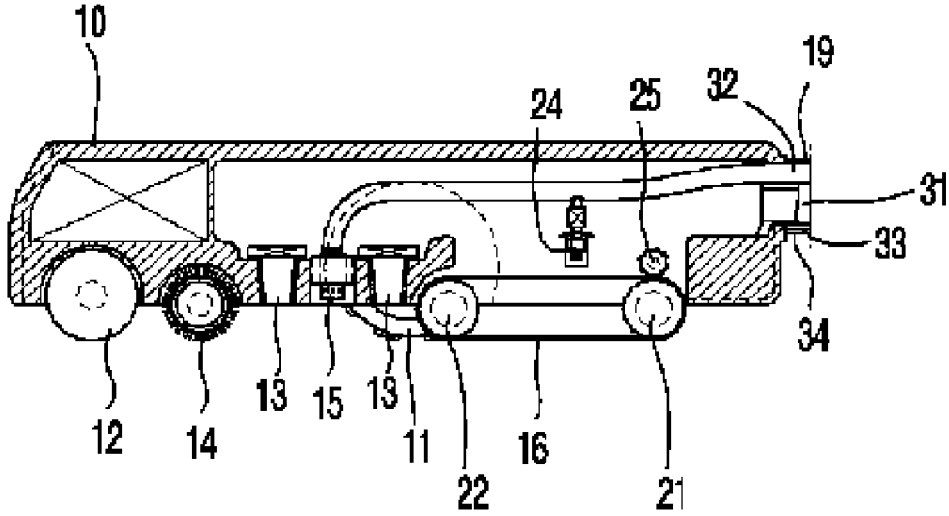

[Fig. 7]
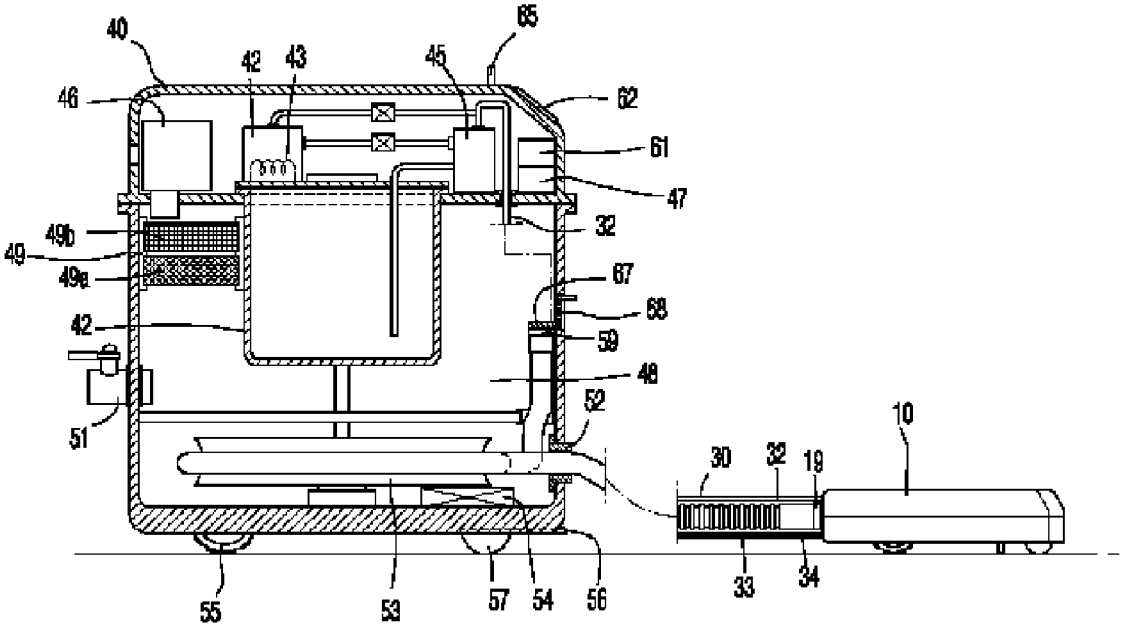

CLEANING ROBOT SYSTEM OF SATELLITE TYPE

TECHNICAL FIELD

The present invention relates to a cleaning robot system of a satellite type.

BACKGROUND ART

A disk-shaped robot cleaner, which can brush and suck dust, is widely used. The robot cleaner can determine regions that need to be cleaned using various sensors to thereby autonomously clean the regions.

In particular, a cleaning mechanism has been improved so that the robot cleaner equally cleans a predetermined region. However, there are basic problems not solved despite the improvement of the navigation mechanism. That is, the robot cleaner should generally have a disk shape with a small height in order to clean a region below furniture such as a bed. Further, since the robot cleaner need recharging, robot cleaner should be operated at low power consumption. Accordingly, it is difficult to expect such satisfactory cleaning performance as achieved when using a high power cleaner. Furthermore, due to the limited electric capacity and spatial limitation of the robot cleaner, it is difficult to select various cleaning options, for example, wet cleaning using steam ejection other than just a vacuum suction. In a worse case, dust cracked finer due to brushing may be dispersed below the furniture.

DISCLOSURE OF INVENTION

Technical Problem

An object of the present invention is to provide a cleaning robot system that has a high vacuum cleaning performance and recharge-free type structure.

Another object of the present invention is to provide a cleaning robot system that can perform wet cleaning.

Still another object of the present invention is to provide a cleaning robot system having an air purifying function that simultaneously performs cleaning and air purification or independently performs air purification.

Technical Solution

According to an aspect of the present invention, a cleaning robot system of a satellite type includes a flat autonomous cleaning head, a hose assembly, and a cleaning main body. The flat autonomous cleaning head includes a suction inlet formed in a bottom thereof, a side connector communicating with the suction inlet, travel wheels provided on both side thereof, and variable speed drive motors for driving the travel wheels. The hose assembly is connected to the cleaning head and is at least partially flexible. The cleaning main body is connected to the hose assembly and includes a vacuum pump, a dust collector, a discharge air separator, a power supply, and a controller. The hose assembly includes vacuum suction line.

The flat autonomous cleaning head may passively move on the basis of control signals transmitted from the controller of the cleaning main body. However, preferably, the autonomous cleaning head may include one or more obstacle sensors and a sub-controller, and may aid the controller of the cleaning main body or may independently move in a travel region. The autonomous cleaning head can turn left or right about the cleaning main body in the travel region on the basis of signals transmitted from the obstacle sensors, which makes it possible for the autonomous cleaning head to randomly move. The travel wheels may be driven by air motors, but are generally driven by electric motors. Further, when the obstacle sensors detect a linear wall, the autonomous cleaning head can move along the linear wall. The number and positions of the obstacle sensors may be changed on the basis of characteristics of the obstacles to be sensed. For example, ultrasonic sensors or infrared sensors may be used as the obstacle sensors. The autonomous cleaning head may include specific sensors, for example, dust detection sensors or position sensors according to the purpose.

According to the aspect of the present invention, preferably, the movement and the cleaning of the cleaning head are centrally controlled by the controller of the cleaning main body. The controller includes a central processing unit and a memory. The controller computes sensor signals received from the sensors that are provided in the cleaning head and the cleaning main body and position signals of the cleaning head, and controls the cleaning head so that the cleaning head performs cleaning in a pattern computed through a predetermined software routine. The travel wheels of the cleaning head are preferably driven by electric motors that are controlled by the controller of the cleaning main body. Further, a control signal line, a power cable, and the hose assembly are connecting the cleaning head to the cleaning main body. The travel wheels may be driven at least in normal and reverse directions and at variable speeds, preferably at multi-steps variable speeds.

Preferably, the cleaning head and/or the cleaning main body may include position sensing units. The cleaning head or the cleaning main body moves along a predetermined path in a region to be cleaned in two ways. One is using an absolute coordinate system. The other is using a relative coordinate system that uses a travel distance and a turning angle from a reference point (for example, a cleaning main body). The position sensing units may use an absolute coordinate system and/or a relative coordinate system. The following method may be used as an example of the method of moving the cleaning head by using the absolute coordinate system. That is, a CCD camera get an image of a ceiling. Objects such as an electric lamp or a fluorescent lamp that is provided on the ceiling, or position detection marks that are intentionally provided on the ceiling so as to be used to detect positions are detected from an image of the ceiling. Then, while a current position of a cleaning head is detected, the cleaning head moves. Alternatively, a light source provided in the ceiling, and an optical PSD (Position Sensitive Detector) sensor may be used in an absolute coordinate system. Preferably, the cleaning main body uses an absolute coordinate system, and the cleaning head uses a relative coordinate system based on the cleaning main body. The cleaning head, which moves in a relative coordinate system, includes a travel distance detection sensor for detecting a travel distance and an angle sensor for detecting a turning angle of the cleaning head. In general, an encoder for detecting the number of rotations of a travel wheel is used as the travel distance detecting sensor, and a gyro sensor is used as the angle sensor for detecting a relative angle. The cleaning head can turn at a desired turning point by a desired angle after going straight. Accordingly, if the gyro sensor is used in the cleaning main body, the cleaning main body is easily controlled but accumulated errors need to be corrected. Another method of detecting a position of the cleaning head is as follows: an optical PSD sensor and a light source are provided in the cleaning head and the cleaning main body, and a relative position of the cleaning head can be detected. This method is more accurate than the encoder method.

The cleaning head of the present invention may include a brush provided in the vicinity of the suction inlet as well as the suction inlet. The brush may be fixed to the cleaning head such that the brush formation is one line or a plurality of lines, and may be rotated in a lateral or longitudinal direction of the cleaning head. The cleaning main body may include a pair of travel wheels driven at variable speeds that can be controlled to be rotated in a reverse direction and separate driven wheels that freely turn in any direction. The cleaning main body is supported and moves by the travel wheels and the driven wheels. Further, the cleaning main body of the present invention may include a wash water container and/or a steam generator. Steam generated by the steam generator is supplied to the cleaning head through a separate hose assembly. Water, hot water, or steam is ejected onto a surface to be cleaned through nozzles provided in the vicinity of the suction inlet of the cleaning head. Therefore, the cleaning main body can also perform wet cleaning. In this case, it is preferable that a steam hose be provided to and assembled with the hose assembly. When the wet cleaning is performed, a detergent may be added to the wash water. Further, since a replaceable porous cleaning cloth is attached to steam nozzles, it is possible to wipe the surface to be cleaned with a wet cloth. Another preferred embodiment of the present invention provides a cleaning head having cleaning region with a belt type or roll type self-wash cloth for wet cleaning.

The hose assembly of the cleaning robot system of the present invention may include a water hose, a hot water hose or a steam supplying hose that is used to supply water or steam, and the vacuum hose separately provided. They can be assembled in the hose assembly, which makes it possible to easily perform maintenance of the hose assembly. Since the hose assembly is made of a flexible material, it is possible to supply water or steam even though the hose assembly is bent. Further, the cleaning main body may include a winder at the lower side thereof if necessary, and may wind or unwind the hose assembly. When the cleaning head moves, the cleaning main body may repeatedly wind or unwind the hose assembly to prevent the cleaning head from interfering with the hose assembly. A power source of the power supply of the cleaning main body may be a rechargeable battery or a power cable. The cleaning main body includes a mounting unit. Accordingly, when the cleaning main body needs to move from one room to another room, the hose assembly is wound by the cleaning main body so that the cleaning head is mounted on the mounting unit. Then, the cleaning main body may move to another region to be cleaned.

In general, the steam generator includes a steam discharge valve, a steam container, and a heater. The steam generator is provided in the cleaning main body, and generally supplies steam to the steam nozzles of the cleaning head through the steam supplying hose. The steam generator may further include a pressure sensor or a water level sensor so as to measure pressure or water level.

The dust collector may include one or more baffles to form water channels. Further, first, contaminated air may be firstly purified by steam showering. The discharge air separator includes various filters. For example, the discharge air separator may include a solid separation filter and a gas-liquid separation filter. Filters corresponding to various sizes of pores according to the purpose may be used as the solid separation filter. The gas-liquid separation filter can separate air from moisture by using a hydrophobic property, or can separate gas from liquid by using a selective membrane. After water-soluble contaminants or gas are removed by dissolving the water-soluble pollutants or gas in steam or water through the water channels of the dust collector, finally, contaminants untrapped by the dust collector are removed with a HEPA filter or an ultra-fine filter provided in the cleaning main body. Other remaining noxious substances are also removed by the filters. Therefore, the cleaning main body discharges air cleaner than a general cleaner. If the filers are made in the form of a cartridge and provided at an outlet of the dust collector, maintenance of them becomes easier. The dust collector preferably is detachable and may have an outlet formed in a bottom thereof. The cleaning main body can simultaneously perform cleaning and air purification or independently perform air purification by using an air purifying function. Wet type air purification using steam ejection and dry type air purification using filters may be performed at the same time. If an air purification mode is selected while the hose assembly is forcibly wound by the winder so that the cleaning head is mounted on the mounting unit of the cleaning main body, the suction inlet of the body communicating with the hose assembly is closed and a separate direct suction inlet is opened so that air purification is performed.

Advantageous Effects

Since the cleaning head of the cleaning robot system according to the present invention has a simple structure, it is possible to make the cleaning head thin to go beneath the furniture. Further, since the cleaning robot system has high output of power and high vacuum sucking performance, it is possible to satisfactorily clean the house. Furthermore, the cleaning robot system can perform wet cleaning by ejecting steam, hot water and wash water unlike a disk-shaped robot cleaner. Therefore, the cleaning robot system can satisfactorily perform all kinds of cleaning options that can be performed by a manual cleaner. In addition, the cleaning robot system can have a self-wash function.

BRIEF DESCRIPTION OF THE DRAWINGS

FIG. 1 is a schematic perspective view of a cleaning robot system according to an embodiment of the present invention;

FIG. 2 is a perspective view showing that a cleaning head is mounted on a cleaning main body in the cleaning robot system according to the embodiment of the present invention;

FIG. 3 is a bottom view of the cleaning head of the cleaning robot system according to the embodiment of the present invention;

FIG. 4 is a schematic cross-sectional view of the cleaning head of the cleaning robot system according to the embodiment of the present invention;

FIG. 5 is a bottom view of another example of the cleaning head of the cleaning robot system according to the embodiment of the present invention;

FIG. 6 is a schematic cross-sectional view of another example of the cleaning head of the cleaning robot system according to the embodiment of the present invention; and FIG. 7 is a cross-sectional view of the cleaning main body of the cleaning robot system according to the embodiment of the present invention.

BEST MODE FOR CARRYING OUT THE INVENTION

A preferred embodiment of the present invention will be described below with reference to the accompanying drawings.

FIGS. 1 and 2 are schematic perspective views of a cleaning robot system according to an embodiment of the present invention. The cleaning robot system includes a flat autonomous cleaning head 10, a hose assembly 30, and a cleaning main body 40. The hose assembly 30 includes a vacuum hose 31, a water or steam hose 32, a power cable 33, and a control line 34, which are assembled with each other. The hose assembly 30 is connected to the cleaning head 10 by a pivotal connector 19 at side of the cleaning head 10. The hose assembly 30 passes through a hose assembly port 52, and is then wound around a winder 53 that is provided at a lower side of the cleaning main body 40. When the robot system moves to a distance or from one room to another room, the hose assembly 30 is retracted by a controller of the cleaning robot body 40 or wound around the winder 53 so that the cleaning head 10 is mounted on a mounting unit 56. In this case, a suction inlet of the body is closed and a separate direct suction inlet is opened, so that air purification is performed.

FIG. 3 is a bottom view of the cleaning head of the cleaning robot system according to the embodiment of the present invention, and FIG. 4 is a schematic cross-sectional view of the cleaning head of the cleaning robot system according to the embodiment of the present invention. A pair of travel wheels 11 and a pair of driven wheels 12 are provided on both sides of the cleaning head. Since the travel wheels can be rotated in normal and reverse directions at variable speeds by drive motors (which are provided in the travel wheels), the cleaning head can turn around one position and turn left or right. The cleaning head includes a rotary brush 14, suction inlets 13, and steam nozzles 15. The type of brush, the number of suction inlets, the type of nozzle, and positions thereof may be modified in various ways.

FIG. 5 is a bottom view of another example of the cleaning head of the cleaning robot system according to the embodiment of the present invention, and FIG. 6 is a schematic cross-sectional view of another example of the cleaning head of the cleaning robot system according to the embodiment of the present invention. A pair of travel wheels 11 and a pair of driven wheels 12 are provided on both sides of the cleaning head. Since the travel wheels can be rotated in normal and reverse directions and at variable speeds by the drive motors, the cleaning head can turn around one position and turn left or right. A rotary brush 14' is provided at the front portion of the cleaning head, and suction inlets 13 and steam nozzles 15 are provided behind the rotary brush, like the cleaning head shown in FIGS. 3 and 4. However, a cleaning cloth belt 16, which is provided at the rear portion of the cleaning head, is wound around a driving roller 21 and a driven roller 22. Further, the cleaning cloth belt can be washed using a pressure roller 25 and wash water or steam nozzles 24. The cleaning cloth belt 16 may be made of a nonwoven fabric, a woven fabric, or plastic foam that have continuous pores. It is preferable that the cleaning cloth belt 16 be made of plastic foam. The cleaning cloth belt 16 may be washed periodically or in predetermined way using the pressure roller 25 and the wash water or steam nozzles 24. When the cleaning cloth belt is contaminated, steam is ejected to the cleaning cloth belt 16 so as to lessen pollutants. Then, the pollutants are separated from the cleaning cloth belt by pressure, and removed from the cleaning cloth belt by vacuum suction. The type of brush, the number of suction inlets, the type of nozzle, and positions thereof may be modified in various ways.

FIG. 7 shows the cleaning main body 40 of the cleaning robot system according to the embodiment of the present invention. The cleaning main body 40 includes a dust collector 48, a power supply 47, and a vacuum pump 46. The dust collector 48 is connected to the vacuum hose 31 through the suction inlet 59 of the body. Before being discharged by the vacuum pump 46, air to be discharged passes through a filter cartridge 49 and is then discharged from the cleaning main body. The cleaning main body 40 is supported by travel wheels 55 and driven wheels 57, and can be moved by electric motors 54. Further, the hose assembly 30 can enter the cleaning main body by the winder 53 through the hose assembly port 52, and can be stored in the cleaning main body. The hose assembly 30 is connected to the suction inlet 59 of the body. The filter cartridge 49 includes a wet filter or gas-liquid separation filter 49*a*, and then a HEPA filter 49*b*. A heater 43 is provided on a steam container 42, and water is supplied to the steam container by a pump 45. When steam pressure exceeds a predetermined pressure, a steam discharge valve discharges steam from the steam container through a steam supply port to supply steam to the steam hose 32. The steam hose may be selectively supplied with steam or water. In this case, the suction inlet 59 of the body is closed and a separate direct suction inlet 68 is opened by a selection closer 67, so that air purification is performed. The controller 61 includes a central processing unit and a memory, and is set by a control board 62. A PSD sensor 65 for sensing the position of the cleaning main body 40 is provided on the cleaning main body in the vicinity of the control board 62.

INDUSTRIAL APPLICABILITY

Since having an excellent cleaning function, the cleaning robot system according to the embodiment of the present invention can be widely used in fields of home cleaning and commercial cleaning.

The invention claimed is:

1. A cleaning robot system of a satellite type, the cleaning robot system comprising:

a flat autonomous cleaning head that includes a suction inlet formed in a bottom thereof, a side connector communicating with the suction inlet, travel wheels provided on both side thereof, and variable speed drive motors for driving the travel wheels;

a hose assembly that is connected to the side connector of the cleaning head and is at least partially flexible; and a cleaning main body that is connected to the hose assembly and includes a vacuum pump, a dust collector, a discharge air separator, a power supply, and a controller, wherein the autonomous cleaning head moves along a travel path on the basis of control signals of the controller of the cleaning main body, wherein the cleaning main body further comprises travel wheels and a drive motor, wherein at least one of the autonomous cleaning head and the cleaning main body includes one or more obstacle sensors or position sensing units, wherein the cleaning main body includes a winder for winding or unwinding the hose assembly at a lower side thereof, and wherein the cleaning main body includes a mounting unit on a side at the lower side thereof, and winds the hose assembly so that the cleaning head is mounted on the mounting unit.

2. A cleaning robot system of a satellite type, the cleaning robot system comprising:

a flat autonomous cleaning head that includes a suction inlet formed in a bottom thereof, a side connector communicating with the suction inlet, travel wheels provided on both side thereof, and variable speed drive motors for driving the travel wheels;

a hose assembly that is connected to the side connector of the cleaning head and is at least partially flexible; and a cleaning main body that is connected to the hose assembly and includes a vacuum pump, a dust collector, a discharge air separator, a power supply, and a controller, wherein the autonomous cleaning head moves along a travel path on the basis of control signals of the controller of the cleaning main body, wherein the cleaning main body further comprises travel wheels and a drive motor, wherein at least one of the autonomous cleaning head and the cleaning main body includes one or more obstacle sensors or position sensing units, wherein the cleaning main body includes a wash water container and/or a steam generator, the hose assembly includes a steam hose, and the cleaning head includes a water nozzle and/or a steam nozzle, and wherein the cleaning head further includes a cleaning cloth belt, which is wound around a driving roller and a driven roller, in order to perform wet cleaning.

3. The cleaning robot system according to claim 2, wherein, the cleaning cloth belt is self-washed at a vacuum suction region in the cleaning head by using a pressure member and water or steam ejectors so that the cleaning head performs wet cleaning.

4. The cleaning robot system according to claim 3, wherein the cleaning cloth belt is pressed between the driven roller and the pressure member and nozzles are provided in the vicinity of the pressure member so as to be washed when contaminated, and the cleaning cloth belt is made of a nonwoven fabric, a woven fabric, or foam.

5. The cleaning robot system according to claim 4, wherein when an air purification mode is selected, a suction inlet of the cleaning main body communicating with a vacuum hose of the hose assembly is closed and a separate direct suction inlet is opened so that air purification is performed.

6. The cleaning robot system according to claim 5, wherein the power supply of the cleaning main body includes a rechargeable battery.

* * * * *